US009551506B2

(12) United States Patent
Azar

(10) Patent No.: US 9,551,506 B2
(45) Date of Patent: Jan. 24, 2017

(54) DEVICE THAT ELIMINATES THE DRAINAGE OF LIQUID DURING THE CHANGING OF A HEATING ELEMENT

(71) Applicant: Chris T Azar, Monroe, NC (US)

(72) Inventor: Chris T Azar, Monroe, NC (US)

( * ) Notice: Subject to any disclaimer, the term of this patent is extended or adjusted under 35 U.S.C. 154(b) by 177 days.

(21) Appl. No.: 14/619,792

(22) Filed: Feb. 11, 2015

(65) Prior Publication Data

US 2015/0308713 A1 Oct. 29, 2015

Related U.S. Application Data

(60) Provisional application No. 61/983,847, filed on Apr. 24, 2014.

(51) Int. Cl.

| | |
|---|---|
| ***F24H 1/18*** | (2006.01) |
| ***A47J 27/00*** | (2006.01) |
| ***H05B 3/78*** | (2006.01) |
| ***F24H 9/18*** | (2006.01) |
| ***F24H 1/20*** | (2006.01) |

(52) U.S. Cl.
CPC ..... *F24H 9/1818* (2013.01); *F24H 1/201* (2013.01); *F24H 1/202* (2013.01)

(58) Field of Classification Search
None
See application file for complete search history.

(56) References Cited

U.S. PATENT DOCUMENTS

| | | | | |
|---|---|---|---|---|
| 42,252 A * | 4/1864 | Curtis | ..... | A01G 23/14 47/52 |
| 64,524 A * | 5/1867 | Gore | ..... | A01G 23/14 47/52 |
| 225,762 A * | 3/1880 | Pierce | ..... | A01G 23/14 47/52 |

(Continued)

*Primary Examiner* — Thor Campbell
(74) *Attorney, Agent, or Firm* — BN IP-Consulting LLC; Binh-An Nguyen

(57) ABSTRACT

Disclosed is a device capable of retaining water in a water heater during the course of changing out the heating element. The device is comprised of a series of parts that fit together in such a way as to allow for a heating element insertion and removal without draining of water from the water heater. Because of the relationship between tubes 4 and 7, and bushings 3 and 5 (teflon, aluminum, or any suitable metal or material) and the threaded piece 1 and heating element tip, screwing in clockwise heating element allows for alignment of these components (tube 4 with slots to align with tube 7 and its slots); slots will be aligned so that water flows through. The heating element is in fluid contact with the water of the water heater. However, unscrewing counter-clockwise the heating element rotates these components in such a fashion as to block the slots in tubes 4 and 7 and the threaded element 1 in order to contain the water of the water heater while the heating element is exchanged for a new one. Upon screwing clockwise the new heating element, the components again go from blocking the water from draining out, to an open channel allowing for continuous fluid flow between the heating element and the water heater. When inserting the new heating element, it is clockwise. The outer tube with an offset of 180 degrees will prevent water from escaping from the water heater.

20 Claims, 4 Drawing Sheets

*Description*

Upper Drawing

| | | |
|---|---|---|
| 1. | Bushing | Item 1 is the bushing and the arrow points to the portion that butts at the device and goes against the water heater tank and may be further sealed by placement of an "O" ring in between 1 and the tank (or around element 2) where 10 is the portion that enters the tank itself. |
| 2. | Inner Tube | Item 2 and 10 are the portion that goes into the tank (and may use an "O" ring, as this portion may butt against the tank). |
| 10. | Outer Tube | For Illustration Only |

*Illustration*

(56) References Cited

U.S. PATENT DOCUMENTS 472,306 A * 4/1892 Mitchell ..... A01G 23/14 47/52
925,681 A * 6/1909 Booth ..... A61F 7/08 219/512
930,361 A * 8/1909 Drake ..... A01G 23/14 47/11
1,191,464 A * 7/1916 Record ..... B67D 1/16 220/717
1,459,311 A * 6/1923 Ozlek ..... B65D 47/06 220/717
1,543,104 A * 6/1925 Hoag ..... A61F 5/445 47/52
1,817,850 A * 8/1931 Schwalbach ..... F01M 5/021 219/205
1,918,414 A * 7/1933 McNey ..... F24H 1/102 122/19.1
2,203,476 A * 6/1940 Trabold ..... B65D 23/00 220/717
2,483,979 A * 10/1949 Morrill ..... A47J 36/2433 215/11.1
2,601,039 A * 6/1952 Livingstone ..... B65D 47/06 222/109
3,213,263 A * 10/1965 Steenbergen ..... H05B 3/06 123/142.5 R
3,399,295 A * 8/1968 Chaustowich ..... H05B 1/0213 219/508
3,637,113 A * 1/1972 Stehl ..... B67B 7/28 222/86
3,672,547 A * 6/1972 Kozlowski ..... B65D 25/48 220/293
3,782,611 A * 1/1974 Wanderer ..... B65D 25/40 222/569
3,899,107 A * 8/1975 Gaal ..... B44D 3/123 220/701
4,270,231 A * 6/1981 Zint ..... A61G 9/006 4/144.1
4,714,053 A * 12/1987 Perry ..... F24H 9/0042 122/159
4,813,383 A * 3/1989 Daugirda ..... F24H 9/0042 122/159
5,152,843 A * 10/1992 McDonald ..... F24H 9/0042 122/379
5,386,100 A * 1/1995 McNair ..... H05B 3/82 219/437
5,406,935 A * 4/1995 Cinotto ..... F16K 5/0642 122/13.01
5,609,124 A * 3/1997 Leclerc ..... F24H 9/0042 122/382
5,823,384 A * 10/1998 Sartori de Zamparolo ..... B65D 17/165 220/717
5,828,810 A * 10/1998 Frank ..... H05B 3/80 219/544
5,921,207 A * 7/1999 DiSalvo ..... F24H 9/0042 122/19.1
5,943,984 A * 8/1999 Lannes ..... F24H 9/124 122/19.1
6,705,485 B1 * 3/2004 Sato ..... A47G 19/2272 220/713
8,320,752 B1 * 11/2012 Bergau ..... A47J 31/46 222/108
2012/0298143 A1 * 11/2012 Mai ..... B08B 9/08 134/21

* cited by examiner

| No. | Part Name | Description | Qty. |
|---|---|---|---|
| 1. | Threaded Rod | Galvenized or Aluminum: $\frac{1}{2}$" - 13 O.D: McMaster #94435A346 | 1 |
| 2. | Heater Element | Provided By Customer | 1 |
| 3. | Aluminum Bushing | Aluminum: $\frac{3}{4}$" Long x .824" O.D. x $\frac{1}{2}$" - 13 Long | 1 |
| 4. | Tube (Inner) | Aluminum: 1.050" O.D. x .824" I.D. x 13.250" Long McMaser # 4481T17 | 1 |
| 5. | Tube End Bushing | Aluminum: 1.050" O.D. x $\frac{3}{4}$" Long | 1 |
| 6. | Bushing | Aluminum: 1.5" Hex x 2.275" Long | 1 |
| 7. | Tube (Outer) | Aluminum: 1.155" ID x 14$\frac{15}{16}$" Long w/ 1 - 10" Long x $\frac{1}{2}$" slot on each side | 1 |
| 8. | Balancing Sleeve | Aluminum Spacer: 1.155" ID | 1 |
| 9. | Nut | Aluminum Nut for $\frac{1}{2}$" Rod | 1 |
| 10. | Threaded Rod notch | Galvenized or Aluminum | 1 |

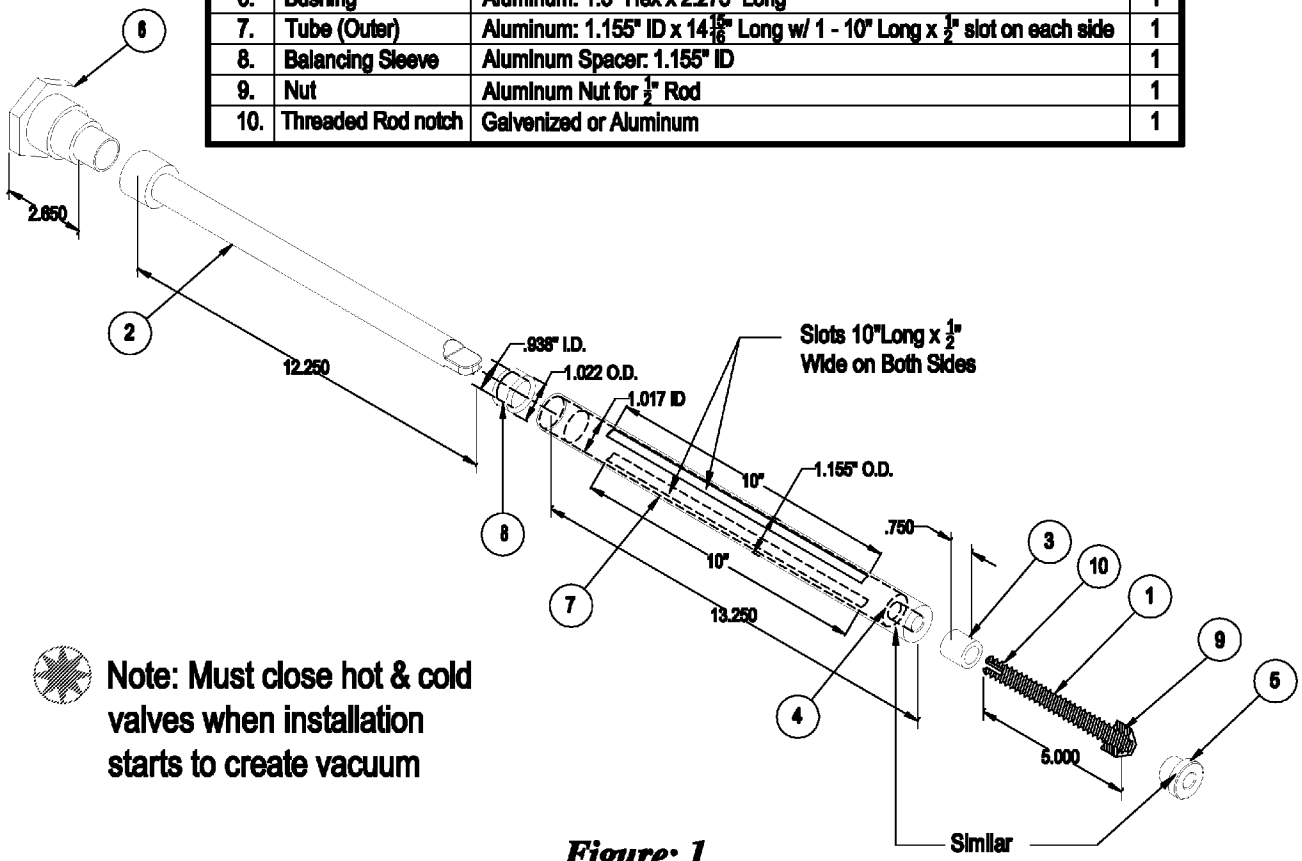

Note: Must close hot & cold valves when installation starts to create vacuum

*Figure: 1*

| No. | Part Name | Description | Qty. |
|---|---|---|---|
| 1. | Threaded Rod | Galvenized or Aluminum: $\frac{1}{2}$" - 13 O.D: McMaster #94435A346 | 1 |
| 2. | Heater Element | Provided By Customer | 1 |
| 3. | Aluminum Bushing | Aluminum: $\frac{3}{4}$" Long x .824" O.D. x $\frac{1}{2}$" - 13 Long | 1 |
| 4. | Tube (Inner) | Aluminum: 1.050" O.D. x .824" I.D. x 13.250" Long McMaser # 4481T17 | 1 |
| 5. | Tube End Bushing | Aluminum: 1.050" O.D. x $\frac{3}{4}$" Long | 1 |
| 6. | Bushing | Aluminum: 1.5" Hex x 2.275" Long | 1 |
| 7. | Tube (Outer) | Aluminum: 1.155" ID x 14$\frac{15}{16}$" Long w/ 1 - 10" Long x $\frac{1}{2}$" slot on each side | 1 |
| 8. | Balancing Sleeve | Aluminum Spacer: 1.155" ID | 1 |
| 9. | Nut | Aluminum Nut for $\frac{1}{2}$" Rod | 1 |
| 10. | Threaded Rod notch | Galvenized or Aluminum | 1 |

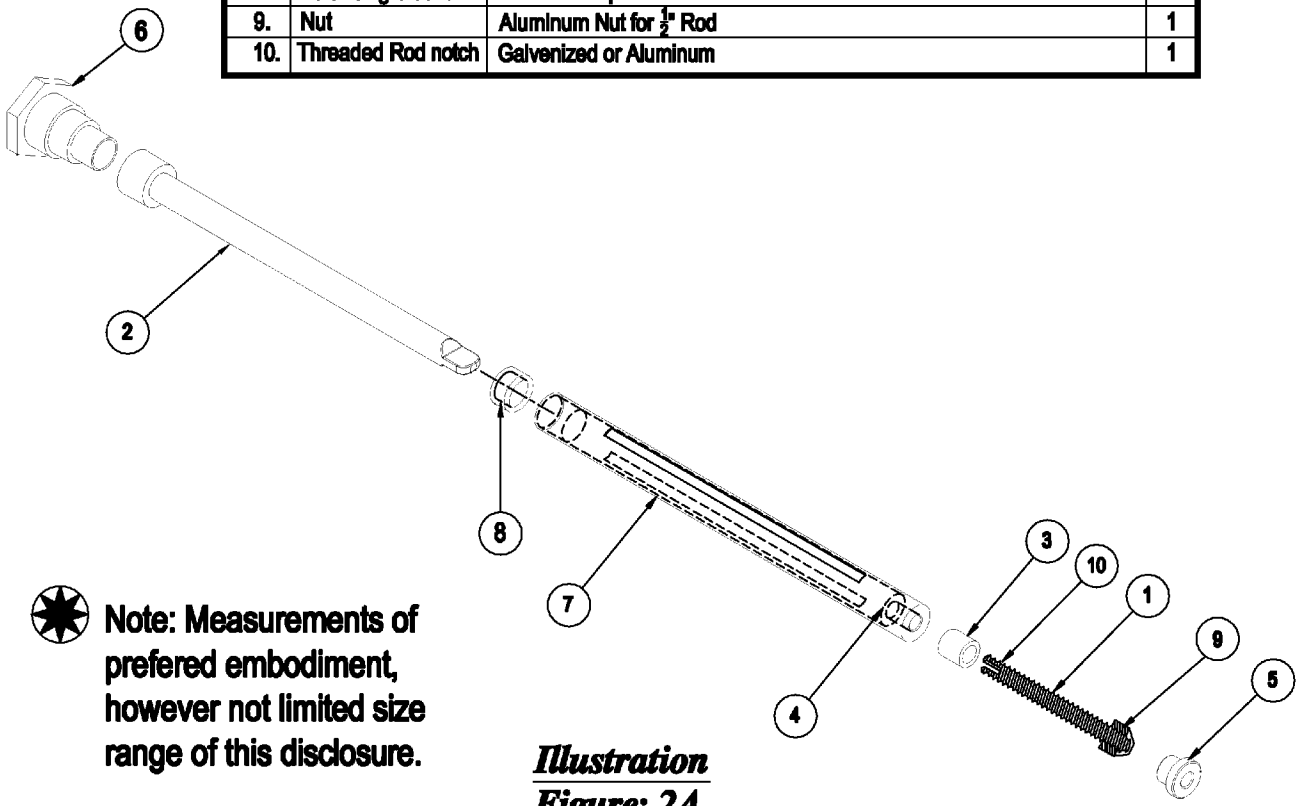

Note: Measurements of prefered embodiment, however not limited size range of this disclosure.

*Illustration Figure: 2A*

| No. | Part Name | Reference Only |
|---|---|---|
| 1. | Threaded Rod | Not Shown |
| 2. | Heater Element | Electric Heaters Element |
| 3. | N/A | Not Shown |
| 4. | Tube (Inner) | Inner Tube w/ Slots |
| 5. | N/A | Not Shown |
| 6. | Bushing | Threaded ID 1" NPT & O.D. |
| 7. | Tube (Outer) | Outer Tube w/ Slots |
| 8. | Balancing Sleeve | To Illustrate Location |
| 9. | Nut | Not Shown : To Illustrate Location |

*Illustration*

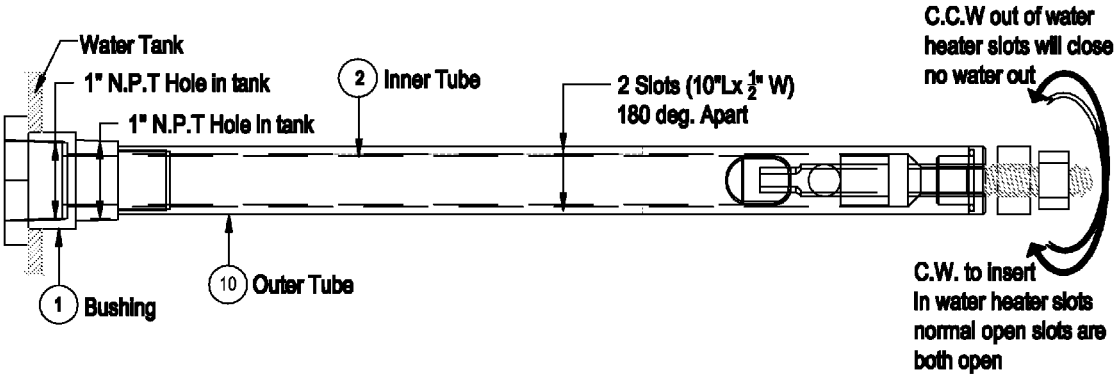

*Figure 3 Description*

Upper Drawing

| | | |
|---|---|---|
| 1. | **Bushing** | Item 1 is the bushing and the arrow points to the portion that butts at the device and goes against the water heater tank and may be further sealed by placement of an "O" ring in between 1 and the tank (or around element 2) where 10 is the portion that enters the tank itself. |
| 2. | **Inner Tube** | Item 2 and 10 are the portion that goes into the tank (and may use an "O" ring, as this portion may butt against the tank). |
| 10. | **Outer Tube** | For Illustration Only |

*Illustration*
*Figure: 3*

DEVICE THAT ELIMINATES THE DRAINAGE OF LIQUID DURING THE CHANGING OF A HEATING ELEMENT

CROSS-REFERENCE TO RELATED APPLICATION

This application claims the benefit of U.S. Provisional Patent Application Ser. No. 61/983,847, filed Apr. 24, 2014, the disclosure of which is incorporated herein by reference.

FIELD OF THE INVENTION

This invention relates to water heaters, heating elements, and water heater accessories.

BACKGROUND OF THE INVENTION

Edwin Rudd, a mechanical engineer invented the first automatic storage water heater in 1889. It is the conventional tank water heater used most commonly today in the USA. His invention was a large tank to store water and a source of heat to heat the water. Water heating is a thermodynamic process uses an energy source to heat water to above its initial temperature. There is a heating element that is installed on the top and on the bottom of the storage tank. It controls the temperature of the water. It is one of the most common elements causing failure to occur in a water heater and will sometimes need to be replaced when the water doesn't get hot for the consumer. Replacing it can be time consuming and inconvenient. It involves getting a garden hose that reaches from the storage tank to the outside of the house or building. The consumer has to be proficient in changing it. The present invention eliminates the need to drain water while replacing the heating element. It will eliminate the inconvenience of draining the water, save water waste and be more cost efficient for the consumer. By improving the water heater with this new device, these problems can be eliminated.

SUMMARY OF THE INVENTION

Accordingly, it is a primary object of the present invention to overcome the abovementioned disadvantages by providing a device capable of retaining water in a water heater during the course of changing out the heating element. The device is comprised of a series of parts that fit together in such a way as to allow for a heating element insertion and removal without draining of water from the water heater.

BRIEF DESCRIPTION OF THE DRAWINGS

FIG. 1 illustrates a device assembly according to the present invention.

FIG. 2A illustrates an embodiment of the device of FIG. 1 showing various measurements.

FIG. 3 illustrates an assembly of the device according to the present invention with the water tank of a water heater.

DETAILED DESCRIPTION

Figure 2B:
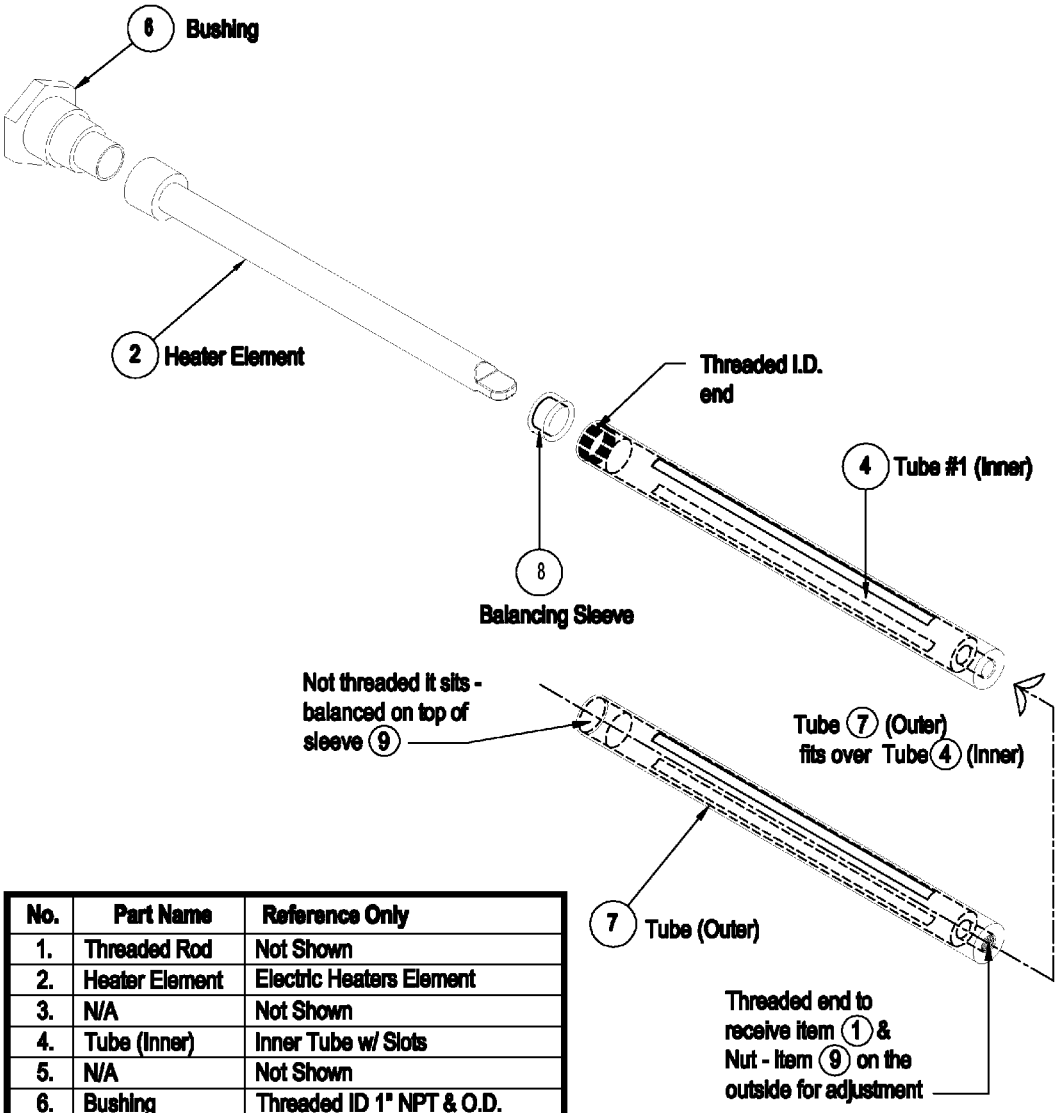
FIG. 2B illustrates another embodiment of the device of FIG. 1 showing various measurements.

Disclosed is a device that is capable of retaining water in a water heater during the course of changing out a heating element. The device is comprised of a series of parts that fit together in such a way as to allow for a heating element to be inserted and removed without the draining of the water heater.

FIG. 1 Description:

Item 1 is a threaded element that is inserted into tubes 4 and 7 and then into 2 to create a water tight seal that enables slots located in tubes 4 and 7 to be lined up with each other with an offset to block exiting water. In the preferred embodiment: THREADED ROD BRASS: ½"—13 O.D.× ¼" DIA. THRU GRAINGER#10P753 1. Element 3 may have a nut on each side that holds 3 in position. Element 3 may be adjustable along the threaded surfaces in order to align the slots on tubes 4 and 7. The device may contain a nut. That adjustment is made by item 9 nut.

Item 2 is a standard heating element that may be purchased separately and installed in the System or may be prefabricated provided as part of the system. In the preferred Embodiment: HEATER ELEMENT PROVIDED BY THE CUSTOMER. The heating element and the device over all may be of any size or shape as necessary for any size or type of water heater design. Using item 1 (solid threaded rod with nut) for that adjustment.

Item 3 is a threaded bushing. In this embodiment the bushing is made of teflon or aluminum, however the invention is not limited to one material. The bushing is placed on the threaded rod (item 1) and can be used as an adjustment to precisely locate the exact opening aligning the slots on tubes 4 (inner) and 7 (outer).

Item 4 is the inner tube that has two slots 180 degrees apart, 10 inches long and ½ inch wide. It allows item 3, when on item 1 (threaded rod) to be inserted inside this tube. Since it is threaded to allow tube 7 (outer) to go over tube 4 with tolerance that is threaded on end of item 1. The lock nut behind tube 7 (the nut adjustment will align the slots via rotation of tube 4 and tube 7. (Note: Diameter of tube 4 is 1.04)

Item 5 is a tube bushing. In the preferred embodiment: TUBE BUSHING ACETAL; 1" O.D.x¾" LONG, ½"—TAP THRU 1.

Item 6 is the bushing. In the preferred embodiment: CHRIS AZAR BUSHING 1.5 HEX×2.275" LONG, THREE TAPS (1"—11. O.D.&I.D. & ⅞"—14 O.D.)

Item 7 is the tube that fits over tube 4 and is slotted the same as tube 4 with the same end thread as tube 4 and a lock nut #9. One end is threaded to accommodate item thread. The other end is open with no thread.

Item 8 is a bushing which in the preferred embodiment is a half inch hole that goes through the tube on both ends. The end of the tube has a bushing as shown in 5.

Item 8 is a balancing sleeve. It acts as a spacer so that tube 7 can sit on it for balance.

Item 9 is a ½ inch nut for adjustment to align the slots of the tubes together.

Item 10 is the groove which is shaped as a complementary structure to the end of the heating element. Shown is a standard heating element, however, the exact design scheme of the end of the heating element and its complementary groove may vary in any manner as would be apparent to those skilled in the art.

Item 2 is one end of a standard heating element.

FIG. 2A Description:

FIG. 2A (Measurements of the preferred embodiment, however, not limited size ranges of this disclosure).

FIG. 2A shows the device of FIG. 1 showing various measurements of some of the parts of the preferred embodiment. The relative sizes of each of the parts as compared to the rest of the device is shown for the preferred embodiment.

The measurements and sizes may vary substantially across the various embodiments as would be recognized by those skilled in the art.

As in FIG. 2B, item 5 points to a threaded portion such that the tube can be threaded on it to get a water seal.

Item 4 is an inner tube with optional covering material.

Item 4 points to slots of tube 7, the outer and inner device that connects the bushing with the heating element.

Item 6 is the bushing located between the heating element and the water storage tank of in some embodiments, a water heater, the 1" N.P.T. opening not shown.

Item 2 is the heating element, specifically the tip that may connect to a complimentary shaped piece such as shown before.

Tube #7 rotates either clockwise as you thread the assembly in tube 4 (slots will meet). Both open so water can be heated.

Adjustment nut ½ inch as in FIG. 1.

Outer tube that is similar in size as the threaded slots except its ID in size goes over tube 4 to align the slots (heating mode) opposite slots (removing heating element). Clockwise, inserting in water heater slots are open/heating mode. Counter-clockwise: Out of the water heater slots will be closed to each other, no water out.

FIG. 2B Description:

Item 4 tube threaded on one end to fit into bushing 5—2 slots, 10 inches long by ½ inch wide. Tube 7 fits over tube 4 so that it has proper alignment. Not shown is the threaded rod that is grooved to mate with the end of item 2 (heating element) so that when there is a rotation of the heating element clockwise with the proper adjustment, the slots will match on the tubes for heating the water. Counter clockwise prevents the drainage of the water. Note: Hot and Cold Water valves have to be closed.

Because of the relationship between tube 4 and its slots, tube 7, bushing 3 and the threaded piece 1 and heating element tip 2, screwing in a heating element allows for-alignment of these components such that the heating element is in fluid contact with the-water of the water heater. However, unscrewing of the heating element rotates these-components in such a fashion as to block the holes in the tube and threaded ½ rod (1) in-order to contain the water of the water heater while the heating element is exchanged for a new one. Upon screwing in a new heating element, the components again go from blocking the water from draining out to an open channel allowing for continuous fluid-flow between the heating element and the water heater.

The materials that can be used in the construction of the device may vary substantially as will be apparent to those skilled in the art. The bushing 3 in the preferred embodiment may be made of teflon, however the bushing as well as other pieces of the device may be made of any number of materials such as aluminum, teflon, plastic, glass, rubber-composite materials and bio metallic materials. The materials that make up parts of the device may also be made of various suitable materials described herein or those that would be recognized by those skilled in the art as suitable.

In more detail, referring to the elements in the figures, the main tube in FIG. 1 contains slots of tube 4 and 7. Threaded device 1 screws into the tube and has a notch 10 which lines up with the end of the heating element inside the tube. The threaded Element 1 is inserted into tube 4 to create a watertight seal and enables slots on tubes 4 and 7 to be lined up with each other, for release of the water when the heating element is in position. Standard heating elements may be used or one may be prefabricated and sold as part of the system. When the heating element is pulled out or rotated out, the outer tube 7 (counter-clockwise) will rotate 180 degrees away from slots on tube 4. This will prevent drainage of the water. Note: Predetermined by the adjustment on element 1 and the nut on the threaded rod).

The preferred embodiment is made up of the materials listed in the description of FIG. 1 such as teflon, brass, acetal, aluminum and others. Many alternative embodiments will be apparent to those skilled in the art and are considered part of this-Disclosure. Materials suitable to the device are plastics, metals, ceramics and woods. Preferred embodiments will be made of either metals, plastics, or a combination of. Limiting factors of materials selection include the necessity of some of the component-being threaded, as well as the necessity of withstanding the temperatures of the water-in the water heater.

Alternative embodiments of the invention include a heating element temporarily connected to a blocking element that covers or uncovers the hole to the storage tank. Any piece of material that may be connected to a heating element, either permanently or non-permanently and may move on and off of a hole that opens to the storage container may be utilized. A piston that may be spring loaded or backed may be used to push a bushing or other device on and off of the hole may also be utilized with the current invention. Further any device that may be designed to be retractable within the basic design elements of, for example, a water heater may also be used. Further any type of storage tank maybe be used and such tank may contain a liquid or a gas. The element may be a heating element or a sensing element. The heating element and water heater are but just one embodiment. Further alternative materials will be recognized by those skilled in the art. Any material that can withstand the temperatures of any water heater may be suitable for the embodiments pertaining to the water heater. Another embodiment is a rubber flexible material that when you insert it on the end of the bushing and make a slot in it to fit the heating element. If it is tight enough, it will prevent water from going out. When you take the element out, the hole will normally close.

The phrase "in one embodiment" is used repeatedly. The phrase generally does not refer to the same embodiment, however it may. The terms, "comprising" "having" and "including" are synonymous unless the context dictates otherwise. The following illustrations of various embodiments use particular terms by way of example to describe the various embodiments, but this should be construed to encompass and provide for-terms such as "method" and "routine" and the like.

Various aspects of the illustrative embodiments will be described using terms employed by those skilled in the art to convey the substance of their work to others skilled in the art. However, it will be apparent to those skilled in the art that the-embodiments described herein may be practiced with only some of the described-aspects.

For purposes of explanation, specific numbers, materials and configurations are set forth in order to provide a thorough understanding of the illustrative embodiments. However it will be apparent to one skilled in the art that the embodiments described herein may be practiced without the specific details. In other instances, well-known features are omitted or simplified in order not to obscure the illustrative embodiments.

The characteristics and utilities of the present invention described in this summary—and the detailed description below are not all inclusive. Many additional features and-advantages will be apparent to one of ordinary skill in the art give the following-description. There has to be outlined, rather broadly, the more important features of the invention in order that the detailed description thereof that follows better understood, and in order that the present contribution to the art may be better appreciated.

In this respect, by explaining at least one embodiment of the invention in detail, it is-to be understood that the invention is not limited in its application to the details of construction and to the arrangements of the components set forth in the description. The invention is capable of other embodiments and of being practiced and carried out in various ways. Also, it is to be understood that the phraseology and terminology employed herein are for the purposes of description and should not be regarded as limiting.

As such those skilled in the art will appreciate that the conception, upon which this disclosure is based, may readily be utilized as a basis for the designing of other structures, methods and systems for carrying out the several purposes of this invention. It is important, therefore, that the description be regarded as including such equivalent constructions in so far as they do not depart from the spirit and scope of the present invention.

Further, the purpose of the foregoing abstract is to enable the U.S. Patent and Trademark Office and the public generally and especially the scientists, engineers, and practitioners in the art who are not familiar with patent, or legal terms or phraseology to determine quickly from a cursory inspection the nature and the essence of the technical disclosure of the application. The abstract is neither intended to define the invention of the application, nor is it intended to be limiting as to the scope of the invention in any way. The characteristics and utilities of the present invention described in this summary and the detailed description below are not all inclusive. Many additional features and advantages will be apparent to one of ordinary skill in the art given the detailed description.

The invention claimed is:

1. A sensing or heating element housing device for a storage tank, wherein a sensing or heating element inserted into a first bushing attachably to a storage tank in such a way that insertion of the sensing or heating element opens a channel between said heating element and said storage tank, and removal of said sensing or heating element blocks said channel, the device comprises:

a first bushing for receiving a sensing or heating element, wherein the first bushing attachably to a storage tank;

an inner tube, having at least two opening slots, connected to the first bushing; and an outer tube, having at least two opening slots, wherein the outer tube is rotatably movable around the inner tube to open said channel by aligning the opening slots of the inner tube and the opening slots of outer tubes, and wherein the outer tube is rotatably movable around the inner tube to block said channel by offsetting the opening slots of the inner tube and the opening slots of the outer tubes.

2. The device of claim 1 further comprises: a first end tube bushing attaching to the inner tube; and a second end tube bushing attaching to the outer tube.

3. The device of claim 1, wherein the first bushing further comprises a threaded element.

4. The device of claim 1, wherein the storage tank contains liquid or gas.

5. The device of claim 1, wherein the storage tank is storage tank of a water heater.

6. The device of claim 3, further comprises: a kit, said kit including a heating element for connecting to the first bushing; and wherein the threaded element connecting the first bushing to an outward end of the heating element, relative to the storage tank, to hold the heating element in place.

7. The device of claim 1 further comprises an O-ring or a gasket located between the first bushing and the storage tank.

8. The device of claim 2 further comprises: a threaded rod, wherein the threaded rod further comprises a notch which lines up with an end of sensing or heating element inside the inner tube; and wherein the threaded rod is movably inserted into the outer and inner tubes via the first and second end tube bushings thereby enabling the slots of the tubes to open said channel when the at least two opening slots of the outer tube and the at least two opening slots of the inner tube are movably aligned on the tubes.

9. The device of claim 6, wherein screwing in the heating element allows for alignment of the slots of the tubes such that the heating element is in fluid contact with water of the water heater; and wherein unscrewing of the heating element rotates the tubes in such a fashion as to block the slots in the tubes or the channel in order to contain the water of the water heater while the sensing or heating element is exchanged for a new one.

10. The device of claim 8 further comprises a nut attachably to the threaded rod, wherein the nut adjusts alignment of the slots of the inner tube and the outer tube.

11. The device of claim 8 further comprises a threaded bushing attachably to the threaded rod, wherein the threaded bushing is adjusted to precisely locate exact alignment of the opening slots of the inner tube and the opening slots of the outer tube.

12. The device of claim 8 further comprises a balancing sleeve, wherein said balancing sleeve is movably inserted into the first bushing, interposing the first bushing and the outer tube, for supporting the outer tube.

13. The device of claim 11, wherein the device is made up from materials consist of teflon, brass, acetal, aluminum, plastics, metals, ceramics, rubber, or a combination thereof.

14. A sensing or heating element housing device for a water heater storage tank, wherein a sensing or heating element non-permanently inserted to a first bushing attachably to a water heater storage tank in such a way that insertion of the sensing or heating element opens a channel between said sensing or heating element and the storage tank, such that the sensing or heating element is in fluid or gas contact with liquid or gas of the water heater, and removal of said sensing or heating element blocks said channel from liquid or gas, the device comprises:

a first bushing having a threaded element for receiving a sensing or heating element, wherein the sensing or heating element having threaded slots, and wherein the first bushing attachably to a storage tank;

an inner tube, having at least two opening slots, connected to the first bushing;

an outer tube, having at least two opening slots;

a first end tube bushing attaching to the inner tube;

and a second end tube bushing attaching to the outer tube; and a threaded rod, wherein the threaded rod having a notch which lines up with an end of a sensing or heating element; wherein the threaded rod is movably inserted into the outer and inner tubes via the first and second end tube bushings, and wherein the outer tube is rotatably movable around the inner tube to open or block said channel.

15. The device of claim 14, wherein rotation of the sensing or heating element along its threaded slots causes equivalent movement of the threaded rod, such that screwing in of a heating element results in the alignment of the opening slots of the tubes thereby unblocking the open of the channel to the water heater storage area, and unscrewing the heating element results in offsetting the opening slots of tubes thereby blocking the open of the channel to the water heater storage area in order to contain the liquid of the water heater while the sensing or heating element is exchanged for a new one.

16. The device of claim 14 further comprises: a nut attachably to the threaded rod, wherein the nut adjusts alignment of the at least two opening slots of the inner tube and the at least two opening slots the outer tube;

a threaded bushing attachably to the threaded rod, wherein the threaded bushing is adjusted to precisely locate the exact alignment of the at least two opening slots of the inner tube and the at least two opening slots of the outer tube;

and a balancing sleeve, wherein said balancing sleeve is movably inserted into the first bushing, interposing the first bushing and the outer tube, for supporting the outer tube.

17. The device of claim 16, wherein the device is made up from materials consist of teflon, brass, acetal, aluminum, plastics, metals, ceramics, rubber, or a combination thereof.

18. The device of claim 14, further comprises a kit, said kit including a heating element for connecting to the first bushing; wherein the threaded element of the first bushing connecting the first bushing to an outward end of the heating element, relative to the storage tank, to hold the heating element in place.

19. A heating or sensing element housing device attachably to a storage tank comprises:

a heating or sensing element; a bushing for inserting or receiving said heating or sensing element;

an inner tube connected to the bushing thereby covers one end of the heating or sensing element, wherein the inner tube having two opening slots;

an outer tube encapsulating the inner tube, wherein the outer tube having two opening slots;

wherein the sensing or heating element non-permanently inserted to said bushing which is attachably to a storage tank in such a way that insertion of the sensing or heating element into said bushing opens a channel between the said heating element and the storage tank, the open channel formed by turning the sensing or heating element clockwise thereby aligning the opening slots of the inner tube and the opening slots of the outer tube;

and wherein removal of the sensing or heating element by turning the sensing or heating element counter clockwise offsetting the opening slots of the inner tube and the opening slots of the outer tube thereby blocks or closes said channel.

20. The device of claim 19 further comprises:

a first end tube bushing attaching to the inner tube; a second end tube bushing attaching to the outer tube;

a threaded rod, wherein the threaded rod is movably inserted into the outer and inner tubes via the first and second end tube bushings thereby enabling the opening slots of the tubes to open said channel when the opening slots of the outer tube and the opening slots of the inner tube are movably aligned on the tubes;

the threaded rod further comprises a notch which lines up with an end of said sensing or heating element inside the inner tube;

a nut attachably to the threaded rod, wherein the nut adjusts alignment of the opening slots of the inner tube and the opening slots of the outer tube;

a threaded bushing attachably to the threaded rod, wherein the threaded bushing is adjusted to precisely locate the exact opening aligning the slots of the inner tube and the outer tube;

and a balancing sleeve, wherein said balancing sleeve is movably inserted into the first bushing, interposing the first bushing and the outer tube, for supporting the outer tube.

* * * * *